United States Patent [19]

Wallace

[11] Patent Number: 4,870,948

[45] Date of Patent: Oct. 3, 1989

[54] PARTIALLY COLLAPSIBLE ENCLOSURE FOR TRASH BURNING RECEPTACLE

[76] Inventor: Donna L. Wallace, 710 W. Fifth St., West Frankfort, Ill. 62896

[21] Appl. No.: 317,960

[22] Filed: Mar. 2, 1989

[51] Int. Cl.[4] ..... F23G 5/00

[52] U.S. Cl. ..... 126/224; 110/241; 52/32; 52/69

[58] Field of Search ..... 126/224, 201; 110/241; 52/32, 69, 127.8

[56] References Cited

U.S. PATENT DOCUMENTS 4,467,781 9/1984 Campbell ..... 126/201

*Primary Examiner*—Carroll B. Dority, Jr.

*Attorney, Agent, or Firm*—Fleit, Jacobson, Cohn, Price, Holman & Stern

[57] ABSTRACT

A peripheral wall assembly is provided defining a horizontal passageway therethrough and including a horizontally swingable wall section for opening and closing the passageway. An inverted generally U-shaped support is centrally disposed within the boundary of the wall assembly and the lower ends of the inverted U-shaped support are pivotally mounted for swinging of the support in a vertical plane between an upright position and a horizontal position with a mid-height portion of the support extending through the passageway. The wall assembly is constructed of fire retardant material. Further, latch structure is provided for maintaining the inverted U-shaped support in an upright position and an upper portion of the support mounts a simulated well rope winding member therefrom.

10 Claims, 1 Drawing Sheet

FIG. 1
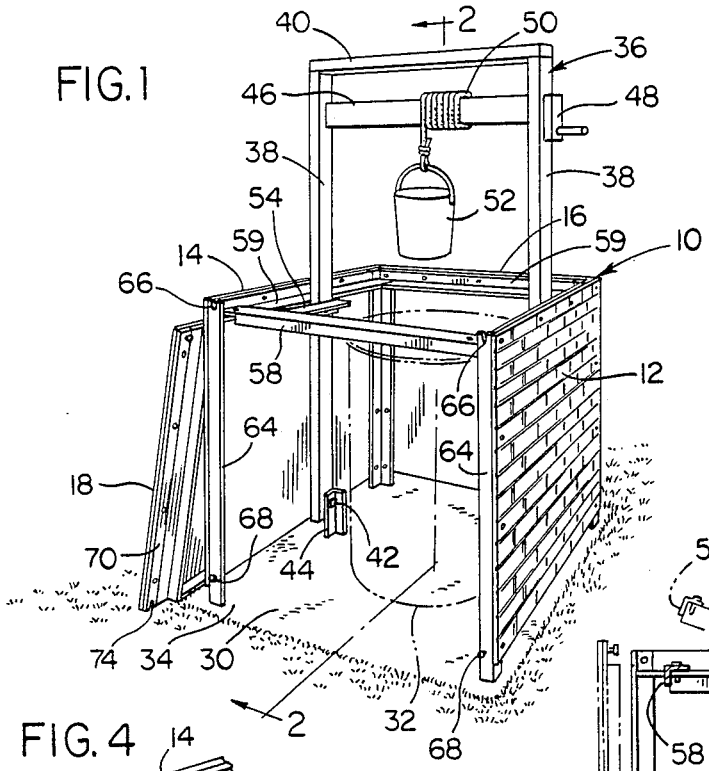
FIG. 2
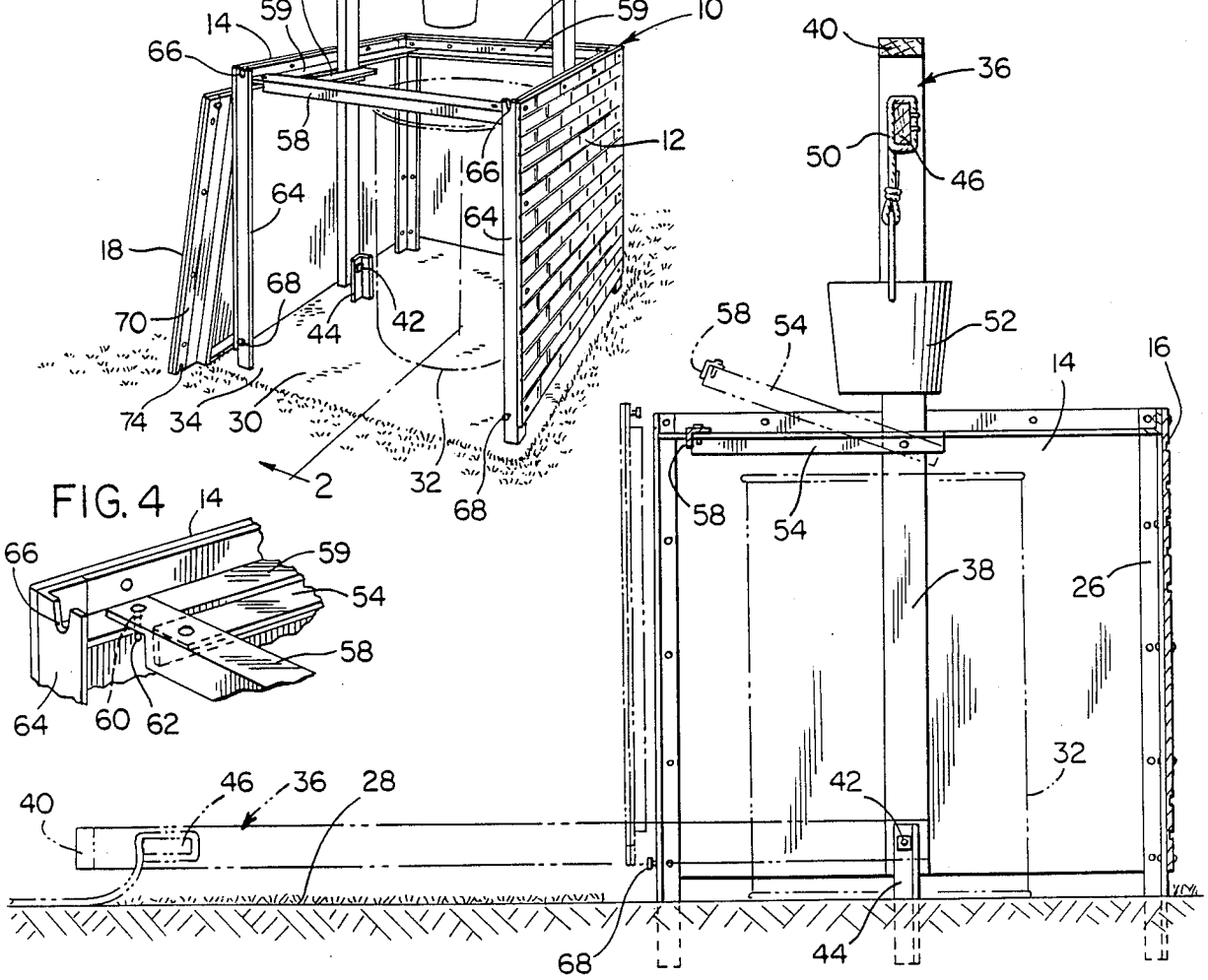
FIG. 4
FIG. 3
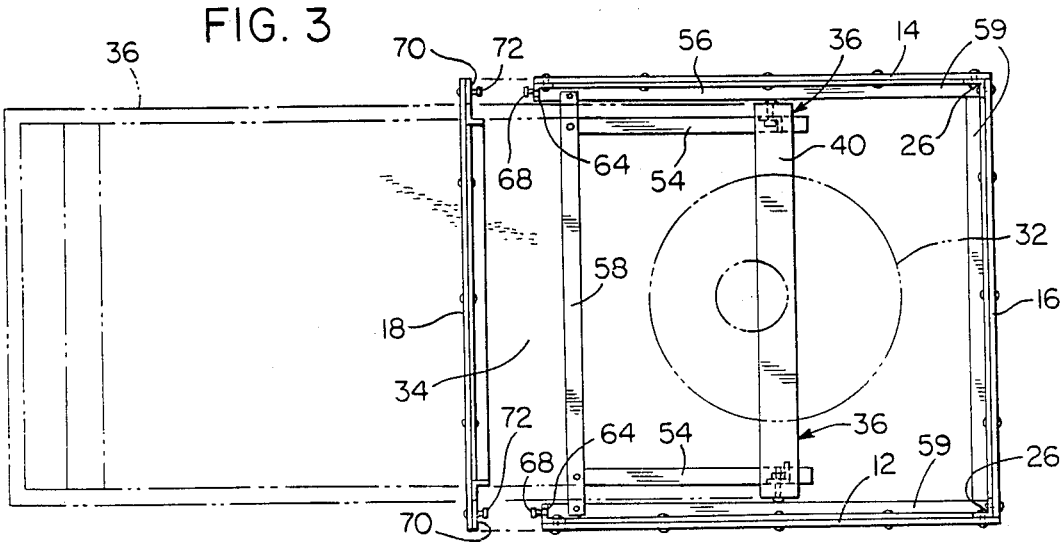

PARTIALLY COLLAPSIBLE ENCLOSURE FOR TRASH BURNING RECEPTACLE

BACKGROUND OF THE INVENTION

1. Field of the Invention

This invention relates to a simulated aboveground well enclosure structure for concealing a trash receptacle therein and including an openable side wall portion thereof to define a horizontal passageway opening into the enclosure structure. The enclosure structure wall portions are fire resistant and the enclosure structure includes an inverted U-shaped simulated well rope winding member support structure therein releasably latched in an upstanding position, but swingable in a vertical plane through the aforementioned passageway when trash within an associated receptacle is being burned.

2. Description of Related Art

Various different forms of trash receptacle enclosures and/or containers heretofore have been provided such as those disclosed in U.S. Pat. Nos. 1,550,043, 3,407,941, 3,667,172, 3,865,449 and 4,655,193. However, these previously known structures do not incorporate the overall combination of structural features comprising the instant invention.

SUMMARY OF THE INVENTION

A simulated open top brick enclosure constructed of fireproof materials is provided and defines a horizontal passageway thereinto. A closure door or wall section is removably mounted in a closed position closing the passageway. Further, an inverted U-shaped support structure is mounted within the enclosure and includes an upper portion simulating a well rope winding member. The U-shaped support is mounted, adjacent its lower end, for swinging in a vertical plane between an upstanding position disposed totally within the plan area of the enclosure and a generally horizontal position with a vertical mid-portion of the U-shaped support structure projecting through the passageway (when the latter is open), whereby the usual upper portion of the U-shaped shaped support structure is displaced out of vertical registry with the receptacle within the enclosure in which trash is being burned.

The main object of this invention is to provide an aesthetically pleasing enclosure for a trash receptacle and an enclosure in which trash within the aforementioned receptacle may be burned without heat damage to any part of the enclosure.

Another object of this invention is to provide an enclosure in accordance with the preceding object and which simulates an aboveground enclosure for a well.

Yet another important object of this invention is to provide an enclosure into which a large trash receptacle may be readily moved and from which a large trash receptacle may be readily removed.

Still another object of this invention is to provide an enclosure in accordance with the preceding objects and which also may be modified to include a weather shielding roof in vertically spaced relation above the simulated well enclosure and an open top trash receptacle therein.

A final object of this invention to be specifically enumerated herein is to provide a simulated aboveground well enclosure in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the trash receptacle enclosure of the instant invention with the entrance door or wall section thereof swung toward an out of the way open position;

FIG. 2 is an enlarged vertical sectional view taken substantially upon the plane indicated by the section line 2—2 of FIG. 1 and illustrating the lowered position of the inverted U-shaped support structure in phantom lines;

FIG. 3 is an enlarged top plan view of the assemblage illustrated in FIG. 1; and FIG. 4 is an enlarged fragmentary vertical sectional view illustrating the releasable latch structure by which the inverted U-shaped support structure of the enclosure is latched in the vertical position thereof.

DESCRIPTION OF THE PREFERRED EMBODIMENT

Referring now more specifically to the drawings, the numeral 10 generally designates an enclosure in which a fireproof trash receptacle may be received. The enclosure 10 includes an upstanding peripheral wall structure incorporating front-to-rear extending opposite side walls 12 and 14, a rear wall 16 extending and interconnected between the rear margins of the opposite side walls 12 and 14 and a front wall or closure 18. The front wall 18 is removably supported from the forward margins of the side walls 12 and 14.

The walls 12, 14, 16 and 18 are constructed of any suitable fire resistant material and include an exterior relief surface simulating common brick, but which also may simulate stone, wood or other building materials. The enclosure walls are supported from four corner angle members 26 whose lower ends are embedded in the ground 28 and, if desired, the lower ends of the angle members 26 may be embedded in concrete (not shown) poured in recesses provided therefor in the ground 28.

The enclosure 10 comprises an open top enclosure disposed about and projecting above a predetermined area 30 of the ground 28 comprising a support for the lower end of a fireproof trash receptacle 32 centrally disposed on the area 30 such that it is spaced inward from the inner surfaces of the walls 12, 14, 16 and 18. The spacing between the forward marginal portions of the walls 12 and 14 defines a horizontal passageway 34 opening into the interior of the enclosure 10 when the wall 18 is in the open position thereof illustrated in FIG. 1. Further, the lower margins of the walls 12, 14, 16 and 18 are spaced slightly above the ground 28 to facilitate the entrance of combustion air into the lower portion of the enclosure 10, the trash receptacle 32 possibly being provided with lower end air inlet openings (not shown) for the entrance of combustion air into the lower end of the trash receptacle 32 when trash is being burned therein.

It is pointed out that the area 30 of the ground 28 will be spaced appreciably from buildings, shrubs and trees which might be heat damaged or set afire as a result of nearby burning trash. Accordingly, the enclosure 10 will be fully exposed to view and, therefore , the exterior of the enclosure 10 has been designed to simulate an aboveground well structure.

In order to complement the well appearance of the enclosure 10, an inverted U-shaped support structure referred to in general by the reference numeral 36 is provided incorporating a pair of uprights or legs 38 interconnected at their upper ends by a horizontal support member 40 extending and secured therebetween. The lower ends of the legs 38 are pivotally mounted as at 42 from ground embedded angle members 44 spaced inward of the front-to-rear mid-portions of the side walls 12 and 14. The pivot axes 42 are substantially aligned and extend transversely of the front-to-rear mid-portion of the enclosure 10.

In addition, the U-shaped support or support structure 36 includes a well rope winding member 46 supported from and extending between the legs 38 a spaced distance below the support member 40. Although the winding member 46 is stationarily mounted, it may be rendered functional, if desired, by rotatably mounting the winding member 46 between the legs 38, one end of the winding member 46 having a crank handle 48 operatively associated therewith on the outside of the leg 38. A length of rope 50 is partially wound around the winding member 46 and a bucket 52 is supported from one free depending end of the rope 50, the bucket 52 being disposed at an elevation spaced above the upper marginal edges of the walls 12, 14, 16 and 18.

The forward sides of the mid-height portions of the legs 38 spaced below the upper marginal edges of the walls 12, 14, 16 and 18 have corresponding rear ends of a pair of angle member latch arms 54 swingably supported therefrom as at 56 and the other forward pair of ends of the arms 54 are interconnected by a connecting bar in the form of an angle member 58 extending and secured therebetween.

The upper margins of the walls 12, 14 and 16 are reinforced by angle members 59, the angle members carried by the walls 12 and 14 having vertical bores 60 formed in the forward end portions thereof through which depending latch pins 62 carried by the ends of the bar 58 are receivable to latch the support structure 36 in the upright position thereof illustrated in Fig. 1. In addition, the forward vertical margins of the walls 12 and 14 include angle members 64 supported therefrom, the upper ends of the angle members 64 having upwardly opening notches 66 formed therein and the lower ends of the angle members 64 having forwardly outstanding headed pins 68 supported therefrom.

The front wall or closure 18 includes straps 70 supported from and extending along the rear sides of the upright side margins of the front wall and the upper ends of the straps include rearwardly projecting headed pins 72 supported therefrom engageable in the notches 66 while the lower ends of the straps 70 include downwardly opening notches 74 engageable downwardly over the pins 68. Thus, the front wall or closure 18 is fully removable from the front of the remainder of the enclosure 10 to open the passageway 34.

When the latch arms 54 are in the horizontal solid line positions thereof illustrated in FIGS. 1–4, the bar 58 has its pins 62 engaged through the bores 60 and the arms 54 and bar 58 therefore act as latch structure for maintaining the inverted U-shaped support structure 36 in the vertical solid line position thereof illustrated in FIGS. 1, 2 and 3.

When the front wall or closure 18 is closed, the enclosure 10 has the appearance of an aboveground well structure and trash to be burned in the future may be placed in the receptacle 32 through the open top of the enclosure 10. When it is desired to burn trash which has accumulated in the receptacle 32, the front wall or closure 18 is removed to open the passageway 34 and the arms 54 and bar 58 are upwardly swung past the phantom line positions thereof illustrated in FIG. 2 and the inverted U-shaped support structure 36 is swung forward and downward to the ground supported position thereof illustrated in phantom lines in FIG. 2. Thus, the vertical mid-portions of the legs 38 are received through the passageway 34 and that portion of the now horizontally disposed support structure 36 projecting outward of the passageway 34 prevents the front wall or closure 18 from swinging to the closed position.

It is also pointed out that the inverted U-shaped support structure 36 may be used to support a lightweight roof structure (not shown) therefrom for the purpose of shielding the trash receptacle 32 from rain. Of course, if such a roof structure is provided, the inverted U-shaped support structure 36, during trash burning operations, will be swung forward and downward to a position slightly less than a horizontal position inasmuch as approximately one-half of the above referred to roof structure will then project below the upper free end of the support structure 36.

In addition, if desired, any suitable latch means (not shown) may be provided for retaining the arms 54 and bar 58 in closely opposing parallel relation to the legs 38 when the arms 54 and bar 58 are swung past the phantom line position thereof illustrated in FIG. 2.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A partially collapsible enclosure for a trash burning receptacle, said enclosure including an open top enclosure structure incorporating upstanding fire resistant peripheral wall means extending about and projecting upwardly above a central horizontal support means area upon which an upwardly opening trash burning receptacle may be placed for burning trash therein, said wall means including a first pair of opposite side wall portions defining horizontally spaced apart corresponding upstanding margins establishing a passageway therebetween for horizontal entrance into and exit from said enclosure, a third wall portion removably positionable in position extending between said margins to close said passageway, a pair of uprights having first upper ends and second lower ends and disposed inward of and adjacent said opposite side wall portions on opposite sides of said area and pivotally mounted at their second lower ends for angular displacement about horizontal axes extending between said second lower ends and swinging between generally vertical upright positions and generally horizontal positions extending through said passageway with said first upper ends disposed outward of said upstanding margins, horizontal support means extending and secured between said first upper ends, and latch means releasably latching said uprights, relative to said wall means, in said upright positions thereof.

2. The enclosure of claim 1 wherein said latch means includes latch structure carried by said uprights and releasably engageable with upper portions of said wall means disposed on opposite sides of said passageway.

3. The enclosure of claim 2 wherein said latch structure includes a pair of generally horizontal arms having front and rear ends, said rear ends of said arms being pivotally supported from said uprights for angular displacement relative thereto about horizontal axes extending between said uprights between generally horizontal positions and positions generally paralleling said uprights, and a connecting bar extending between and interconnecting the front ends of said arms remote from said uprights, the opposite ends of said connecting bar including means releasably engageable with keeper means carried by said upper portions of said wall means on opposite sides of said passageway.

4. The enclosure of claim 3 wherein said means releasably engagable with keeper means include downwardly projecting pins carried by the opposite ends of said bar including portions thereof removably downwardly engageable with said keeper means.

5. The enclosure of claim 1 including support means mounting said third wall portion from the portions of said wall means disposed on opposite sides of said passageway for full removal of said third wall portion from a closed position closing said passageway.

6. In combination, an enclosure for a trash burning receptacle, said enclosure including upstanding wall means disposed about and projecting upwardly above a support means area for said trash receptacle, said wall means including a fire resistant stationary upstanding wall assembly extending peripherally about said support means area to an extent defining a horizontal passageway through said wall assembly on one side of said support means area for horizontal ingress and egress of said receptacle through said passageway relative to said support means area, an inverted generally U-shaped support structure including a pair of uprights depending downwardly from a horizontal support member extending and interconnected between upper end portions of said uprights, means mounting the lower end portions of said uprights to opposite sides of said support means area for angular displacement about axes extending between said opposite sides of said support means area between upright operative positions and generally horizontal positions with intermediate height portions of said uprights extending through said passageway, and latch means releasably latching said uprights in said operative positions thereof.

7. The combination of claim 6 wherein said latch means includes latch structure carried by said uprights and releasably engageable with upper portions of said wall means disposed on opposite sides of said passageway.

8. The combination of claim 7 wherein said support structure supports a winding shaft extending between said uprights below said support member.

9. The combination of claim 7 wherein said wall assembly includes a simulated brick exterior surface.

10. The combination of claim 7 including a closure wall section removably mounted from the portions of said wall assembly disposed at opposite sides of said passageway closing the latter.

* * * * *